US010145608B2

(12) United States Patent
Chae et al.

(10) Patent No.: US 10,145,608 B2
(45) Date of Patent: Dec. 4, 2018

(54) REFRIGERATOR AND METHOD OF CONTROLLING THE SAME

(71) Applicant: LG ELECTRONICS INC., Seoul (KR)

(72) Inventors: Sunam Chae, Seoul (KR); Kyungseok Kim, Seoul (KR); Kyeongyun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/304,002

(22) PCT Filed: Apr. 14, 2015

(86) PCT No.: PCT/KR2015/003700
§ 371 (c)(1),
(2) Date: Oct. 13, 2016

(87) PCT Pub. No.: WO2015/160162
PCT Pub. Date: Oct. 22, 2015

(65) Prior Publication Data

US 2017/0038129 A1 Feb. 9, 2017

(30) Foreign Application Priority Data

Apr. 14, 2014 (KR) ..... 10-2014-0044419

(51) Int. Cl.
*F25D 17/06* (2006.01)
*F25D 29/00* (2006.01)
*F25D 11/02* (2006.01)

(52) U.S. Cl.
CPC ..... *F25D 29/00* (2013.01); *F25D 11/022* (2013.01); *F25D 17/065* (2013.01);
(Continued)

(58) Field of Classification Search
CPC ..... F25D 29/00; F25D 11/022; F25D 17/065; F25D 2700/12; F25D 2700/122;
(Continued)

(56) References Cited

U.S. PATENT DOCUMENTS 8,720,222 B2 * 5/2014 Cur ..... F25D 11/006 62/442
9,714,785 B2 * 7/2017 Cur ..... F25D 11/022
(Continued)

FOREIGN PATENT DOCUMENTS

CN 101684979 3/2010
CN 102679606 9/2012
(Continued)

OTHER PUBLICATIONS

Office Action issued in Korean Application No. 10-2014-0044419 dated Aug. 3, 2015, 7 pages.
(Continued)

*Primary Examiner* — Melvin Jones
(74) *Attorney, Agent, or Firm* — Fish & Richardson P.C.

(57) ABSTRACT

A refrigerator including a refrigerator body including a refrigerating compartment and a freezing compartment, a refrigerating compartment cooling circuit including a refrigerating compartment compressor for compressing refrigerant, a refrigerating compartment condenser, a refrigerating compartment expansion unit, and a refrigerating compartment evaporator for causing the refrigerant to exchange heat with the refrigerating compartment; a freezing compartment cooling circuit including a freezing compartment compressor for compressing refrigerant, a freezing compartment condenser, a freezing compartment expansion unit, and a freezing compartment evaporator; a refrigerating compartment temperature sensor; a freezing compartment temperature sensor; and a control unit for controlling the refriger-
(Continued)

ating compartment compressor and the freezing compartment compressor to be concurrently operated so as to proceed to a concurrent operation mode when the refrigerating compartment and the freezing compartment are under a concurrent cooling condition, and for controlling one or both of the refrigerating compartment compressor and the freezing compartment compressor to be operated so as to proceed to a selective operation mode in consideration of a previous operation state when the refrigerating compartment and the freezing compartment are under a selective cooling condition.

10 Claims, 4 Drawing Sheets

(52) U.S. Cl.
CPC ... *F25B 2400/06* (2013.01); *F25B 2600/0251* (2013.01); *F25B 2600/0252* (2013.01); *F25B 2600/112* (2013.01); *F25D 2700/12* (2013.01); *F25D 2700/122* (2013.01)

(58) Field of Classification Search
CPC .... F25D 23/003; F25D 23/01; F25D 2400/04; F25B 2400/06; F25B 2600/0251; F25B 2600/0252; F25B 2600/112
USPC ..... 62/89, 440
See application file for complete search history.

(56) References Cited

U.S. PATENT DOCUMENTS

| | | | | |
|---|---|---|---|---|
| 2011/0030402 | A1 | 2/2011 | Shinya et al. | |
| 2012/0023980 | A1 | 2/2012 | Lee et al. | |
| 2013/0098081 | A1* | 4/2013 | Cur | F25D 11/006 62/117 |

FOREIGN PATENT DOCUMENTS

| | | |
|---|---|---|
| CN | 103542686 | 1/2014 |
| EP | 2685188 | 1/2014 |
| JP | H10153375 | 6/1998 |
| JP | 2013-092291 | 5/2013 |
| KR | 10-2000-0019107 | 4/2000 |
| KR | 10-2005-0097186 | 10/2005 |
| KR | 102008006753 | 6/2009 |

OTHER PUBLICATIONS

Extended European Search Report in European Application No. 15780650.6, dated Oct. 5, 2017, 8 pages (with English translation).
International Search Report and Written Opinion in International Application No. PCT/KR2015/003700, dated Aug. 20, 2015, 8 pages.
Chinese Office Action in Chinese Application No. 201580031991.2, dated Jun. 28, 2018, 16 pages.

* cited by examiner

[Fig. 1]
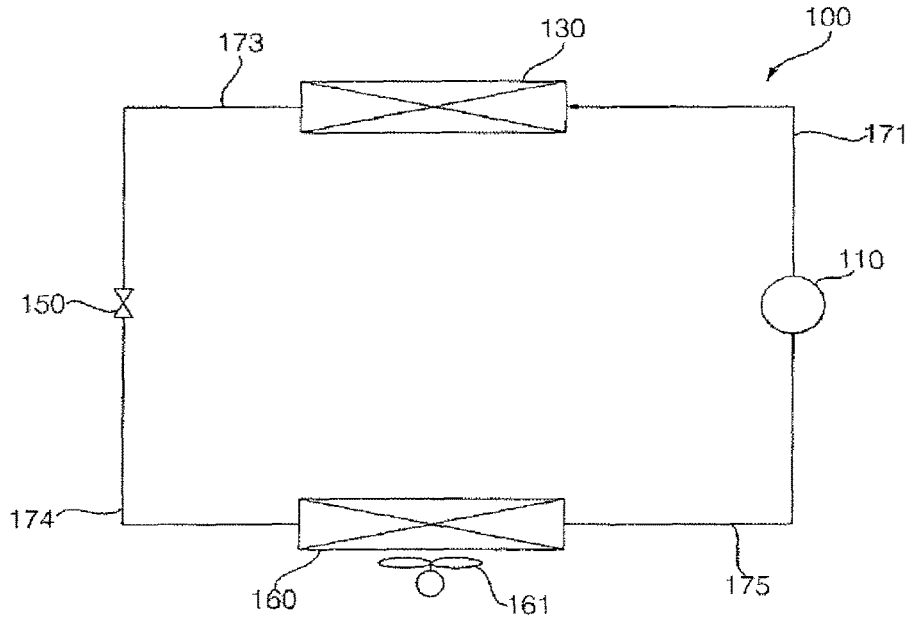
(a)
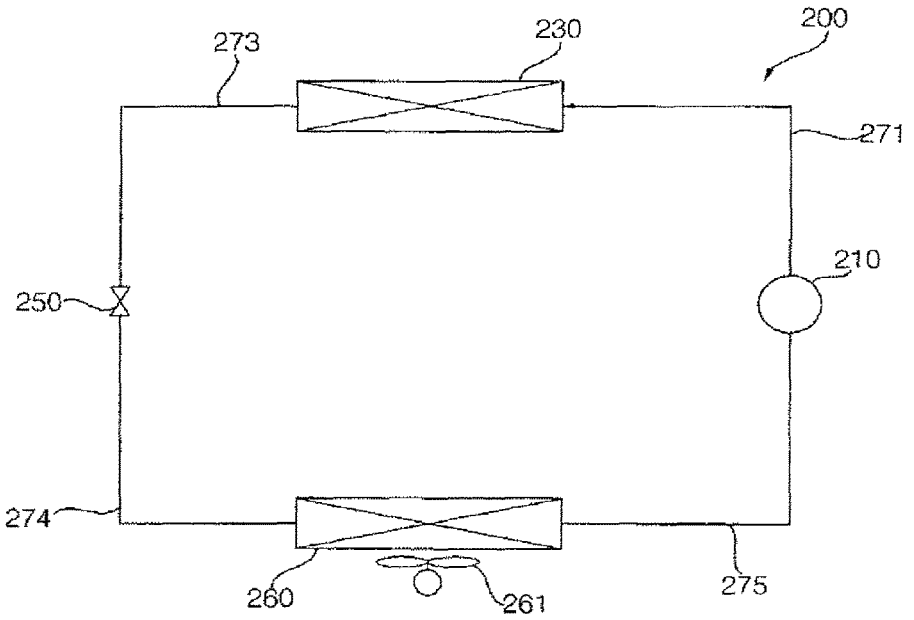
(b)

[Fig. 2]
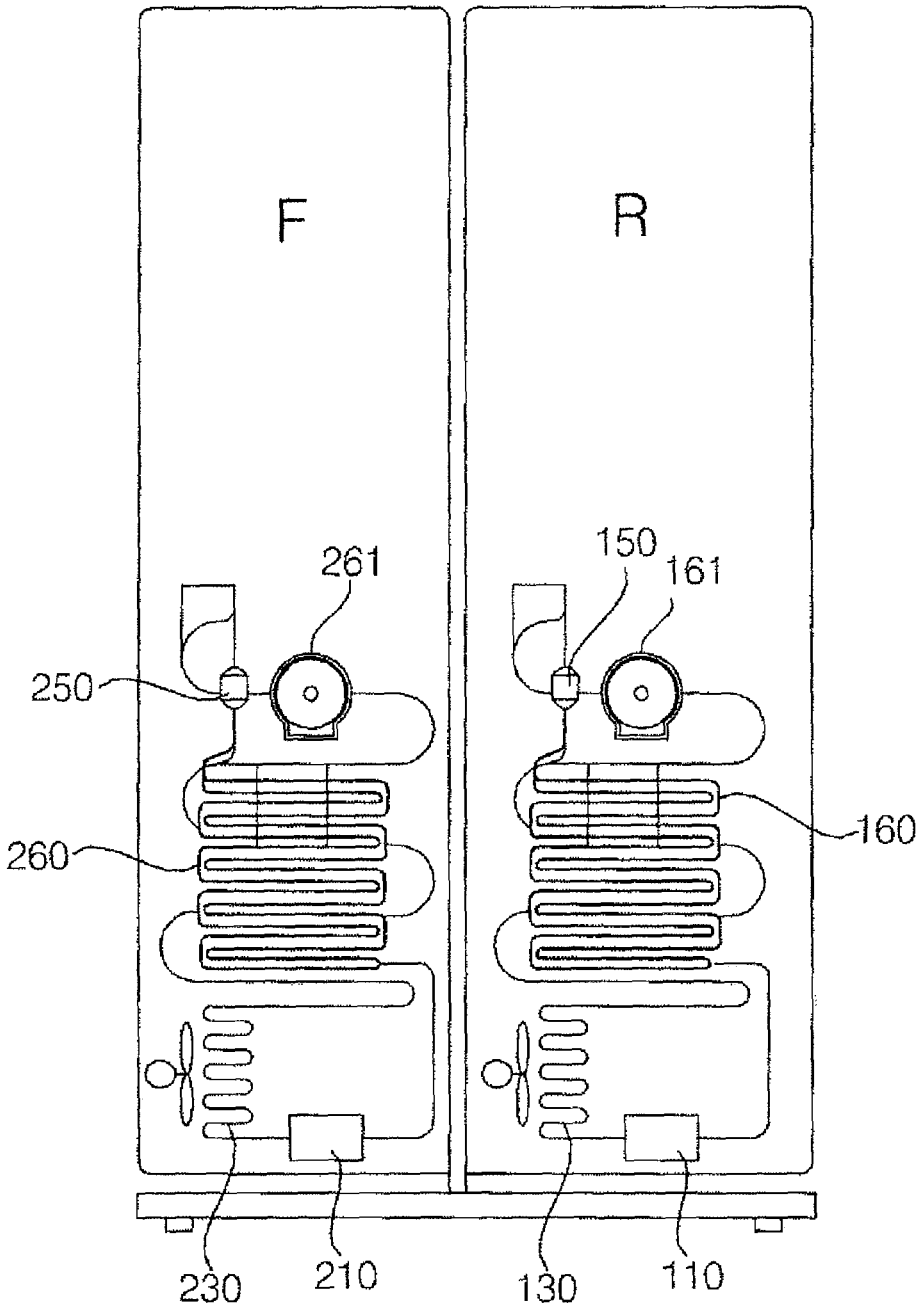

[Fig. 3]

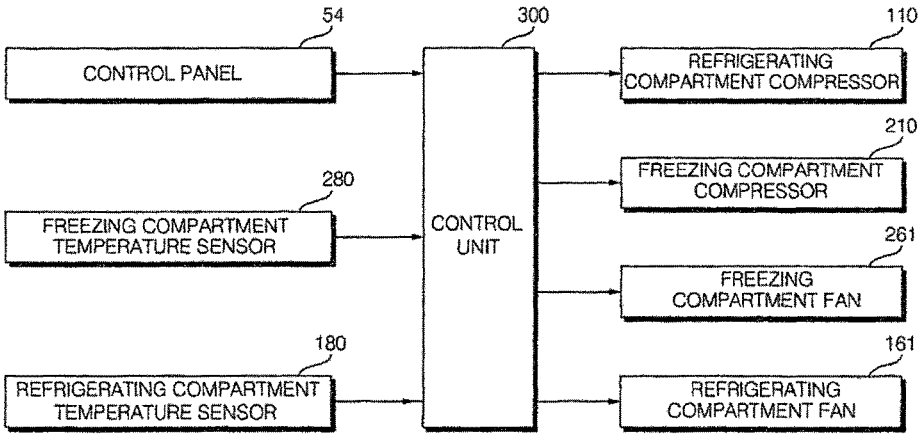

[Fig. 4]

| OPERATION MODE | FREEZING COMPARTMENT | REFRIGERATING COMPARTMENT | PREVIOUS OPERATION STATE | COMPRESSOR | |
|---|---|---|---|---|---|
| | | | | FREEZING | REFRIGERATING |
| STOP MODE | SATISFACTION | SATISFACTION | - | OFF | OFF |
| SINGLE OPERATION MODE | | LOW TEMPERATURE | - | OFF | ON |
| | | HIGH TEMPERATURE | - | OFF | ON |
| | LOW TEMPERATURE | SATISFACTION | - | ON | OFF |
| SELECTIVE OPERATION MODE | | LOW TEMPERATURE | REFRIGERATING OPERATION | OFF | ON |
| | | | FREEZING OPERATION | ON | OFF |
| | | HIGH TEMPERATURE | REFRIGERATING OPERATION | OFF | ON |
| | | | FREEZING OPERATION | ON | ON |
| SINGLE OPERATION MODE | HIGH TEMPERATURE | SATISFACTION | - | ON | OFF |
| SELECTIVE OPERATION MODE | | LOW TEMPERATURE | REFRIGERATING OPERATION | ON | ON |
| | | | FREEZING OPERATION | ON | OFF |
| CONCURRENT OPERATION MODE | | HIGH TEMPERATURE | | ON | ON |

[Fig. 5]
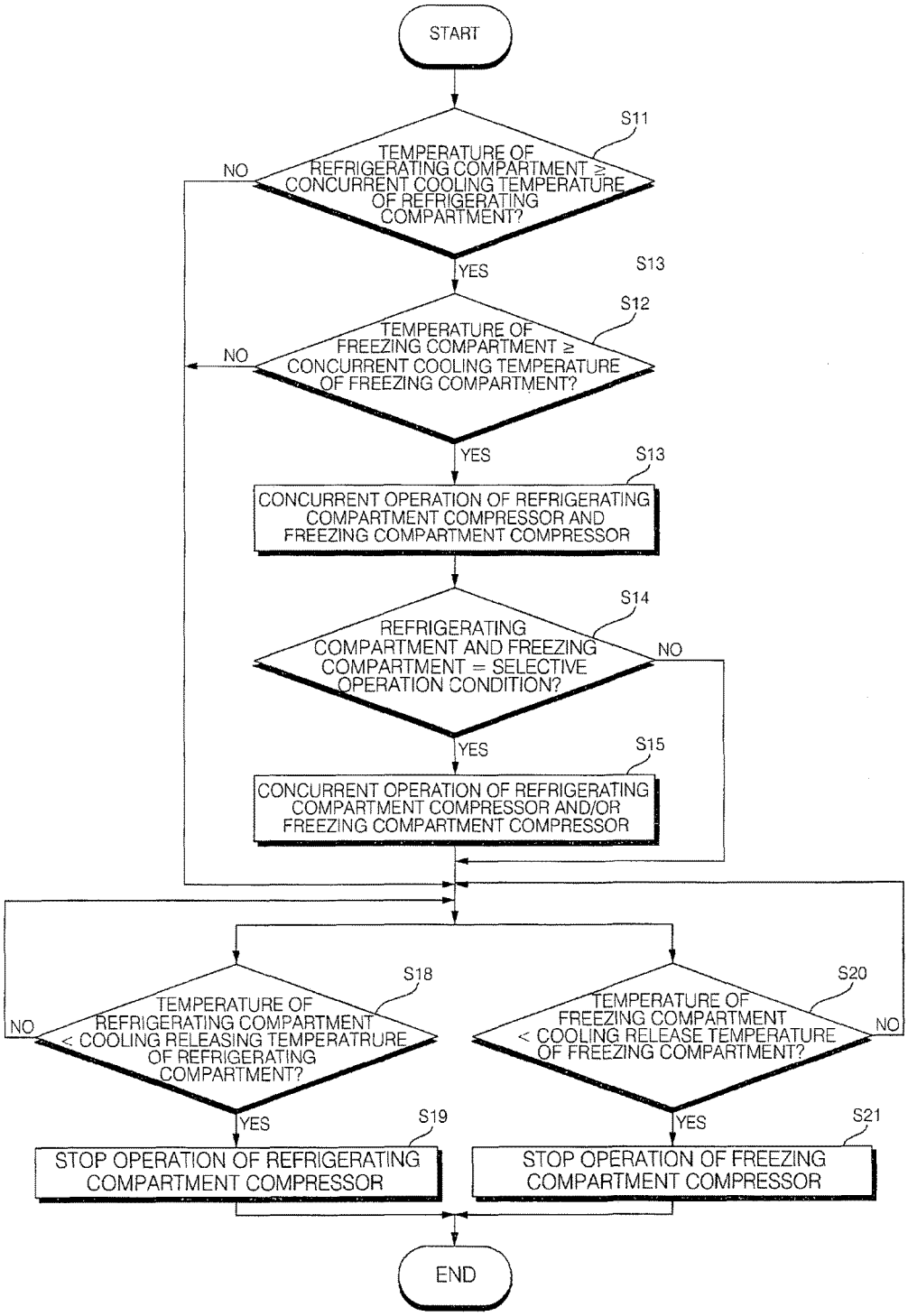

REFRIGERATOR AND METHOD OF CONTROLLING THE SAME

CROSS REFERENCE TO RELATED APPLICATIONS

This application is a U.S. National Phase Application under 35 U.S.C. § 371 of International Application PCT/KR2015/003700, filed on Apr. 14, 2015, which claims the benefit of Korean Application No. 10-2014-0044419, filed on Apr. 14, 2014, the entire contents of which are hereby incorporated by reference in their entireties.

TECHNICAL FIELD

The present invention relates to a refrigerator and a method of controlling the same.

BACKGROUND ART

In general, a refrigerator is an apparatus that stores objects in a fresh state for a long period of time using cool air supplied into a storage compartment. The cool air supplied into the storage compartment is generated through heat exchange of a refrigerant. The cool air supplied into the storage compartment is uniformly distributed in the storage compartment by convection to store foods at desired temperature.

Such a refrigerator may be constructed not only such that a freezing compartment and a refrigerating compartment are cooled by a single evaporator but also such that a freezing compartment and a refrigerating compartment are cooled by a freezing compartment evaporator and a refrigerating compartment evaporator, respectively.

Particularly, as a conventional method of controlling a refrigerator, there is proposed a method designed to alternately cool a refrigerating compartment and a freezing compartment using one compressor and two evaporators by means of a changeover valve.

However, the conventional method has problems in that it is difficult to achieve rapid cooling when the changeover valve is alternately opened toward the two evaporators during initial start-up of the compressor and that cooling of a refrigerating compartment is excessively delayed when cooling is initiated from a freezing compartment during the initial start-up of the compressor.

Furthermore, although it is necessary to provide rapid cooling when a temperature of one of a freezing compartment and a refrigerating compartment is excessively increased, the rapid cooling cannot be easily achieved.

DISCLOSURE OF INVENTION

Technical Problem

It is an object of the present invention to provide a refrigerator configured to concurrently cool a freezing compartment and a refrigerating compartment so as to rapidly cool the compartments.

It is another object of the present invention to provide a method of controlling a refrigerator which is configured to reduce noise generated when a freezing compartment and a refrigerating compartment are concurrently cooled and to more efficiently cool both the freezing compartment and the refrigerating compartment.

Solution to Problem

In accordance with an aspect of the present invention, the above and other objects can be accomplished by the provision of a refrigerator including a refrigerator body including a refrigerating compartment and a freezing compartment; a refrigerating compartment cooling circuit including a refrigerating compartment compressor for compressing refrigerant, a refrigerating compartment condenser for condensing the refrigerant compressed in the refrigerating compartment compressor, a refrigerating compartment expansion unit for expanding the refrigerant condensed in the refrigerating compartment condenser, and a refrigerating compartment evaporator for evaporating the refrigerant expanded in the refrigerating compartment expansion unit to cause the refrigerant to exchange heat with the refrigerating compartment; a freezing compartment cooling circuit including a freezing compartment compressor for compressing refrigerant, a freezing compartment condenser for condensing the refrigerant compressed in the freezing compartment compressor, a freezing compartment expansion unit for expanding the refrigerant condensed in the freezing compartment condenser, and a freezing compartment evaporator for evaporating the refrigerant expanded in the freezing compartment expansion unit to cause the refrigerant to exchange heat with the freezing compartment; a refrigerating compartment temperature sensor for measuring a temperature of the refrigerating compartment; a freezing compartment temperature sensor for measuring a temperature of the freezing compartment; and a control unit for controlling the refrigerating compartment compressor and the freezing compartment compressor to be concurrently operated so as to proceed to a concurrent operation mode when the refrigerating compartment and the freezing compartment are under a concurrent cooling condition, and for controlling one or both of the refrigerating compartment compressor and the freezing compartment compressor to be operated so as to proceed to a selective operation mode in consideration of a previous operation state when the refrigerating compartment and the freezing compartment are under a selective cooling condition.

In accordance with another aspect of the present invention, the above and other objects can be accomplished by the provision of a method of controlling a refrigerator including a refrigerating compartment cooling circuit including a refrigerating compartment compressor for compressing refrigerant, a refrigerating compartment condenser for condensing the refrigerant compressed in the refrigerating compartment compressor, a refrigerating compartment expansion unit for expanding the refrigerant condensed in the refrigerating compartment condenser, and a refrigerating compartment evaporator for evaporating the refrigerant expanded in the refrigerating compartment expansion unit to cause the refrigerant to exchange heat with a refrigerating compartment; and a freezing compartment cooling circuit including a freezing compartment compressor for compressing refrigerant, a freezing compartment condenser for condensing the refrigerant compressed in the freezing compartment compressor, a freezing compartment expansion unit for expanding the refrigerant condensed in the freezing compartment condenser, and a freezing compartment evaporator for evaporating the refrigerant expanded in the freezing compartment expansion unit to cause the refrigerant to exchange heat with a freezing compartment, the method including a concurrent cooling operation of controlling the refrigerating compartment compressor and the freezing compartment compressor to be concurrently operated so as to proceed to a concurrent operation mode, a selective cooling operation of controlling one or both of the refrigerating compartment compressor and the freezing compartment compressor to be operated so as to proceed to a selective operation mode in consideration of a previous operation state, and a single cooling operation of controlling one of the refrigerating compartment compressor and the freezing compartment compressor to be operated so as to proceed to a single operation mode.

BRIEF DESCRIPTION OF DRAWINGS

The above and other objects, features and other advantages of the present invention will be more clearly understood from the following detailed description taken in conjunction with the accompanying drawings, in which:

FIG. 1 is a view illustrating a schematic construction of a refrigerator according to an embodiment of the present invention;

FIG. 2 is a view schematically illustrating an internal construction of the refrigerator according to the embodiment of the present invention;

FIG. 3 is a control block diagram illustrating the refrigerator according to the embodiment of the present invention;

FIG. 4 is an operation table illustrating operation states of the refrigerating compartment compressor and the freezing compartment compressor at various operation modes and various temperatures of the refrigerating compartment and the freezing compartment according to the embodiment of the present invention; and FIG. 5 is a flowchart illustrating a method of controlling a refrigerator according to an embodiment of the present invention.

MODE FOR THE INVENTION

Advantages and features of the present invention and a method of achieving the same will be more clearly understood from embodiments described below with reference to the accompanying drawings. However, the present invention is not limited to the following embodiments and may be implemented in various different forms. The embodiments are provided merely for complete disclosure of the present invention and to fully provide a person having ordinary skill in the art to which the present invention pertains with the category of the invention. The invention is defined only by the category of the claims. Wherever possible, the same reference numbers will be used throughout the specification to refer to the same or like elements.

The terminology used in this specification serves to describe particular embodiments only and is not intended to limit the present invention. As used in this specification, the singular forms are intended to include the plural forms as well unless context clearly indicates otherwise. It will be further understood that the terms "comprises" and/or "comprising", when used in this specification, specify the presence of stated elements, steps, and/or operations, but do not preclude the presence or addition of one or more other elements, steps, and/or operations.

Unless otherwise defined, all terms (including technical and scientific terms) used in this specification have the same meaning as commonly understood by a person having ordinary skill in the art to which the present invention pertains. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Hereinafter, a refrigerator according to an embodiment of the present invention will be described with reference to the accompanying drawings.

FIG. 1 is a view illustrating a schematic construction of the refrigerator according to the embodiment of the present invention. FIG. 2 is a view schematically illustrating an internal construction of the refrigerator according to the embodiment of the present invention.

As illustrated in FIGS. 1 and 2, the refrigerator according to the embodiment includes a refrigerator body including a refrigerating compartment R and a freezing compartment F, a refrigerating compartment cooling circuit 100 for cooling the refrigerating compartment R, and a freezing compartment cooling circuit 200 for cooling the freezing compartment F.

The refrigerator according to the embodiment may further include a refrigerating compartment temperature sensor 180 for measuring a temperature of the refrigerating compartment R, a freezing compartment temperature sensor 280 for measuring a temperature of the freezing compartment F, and a control unit 300 for concurrently or separately controlling a refrigerating compartment compressor 110 and the freezing compartment compressor 210.

A schematic construction of the refrigerator is first described with reference to FIGS. 1 and 2.

The refrigerator body includes therein the refrigerating compartment R and the freezing compartment F. The refrigerating compartment R is an insulated space in which refrigerated objects are accommodated, and the freezing compartment F is another insulated space in which frozen objects are accommodated.

The refrigerator compartment cooling circuit 100 is configured to cool the refrigerator R by circulating refrigerant.

For example, the refrigerating compartment cooling circuit 100 includes the refrigerating compartment compressor 110 for compressing refrigerant, a refrigerating compartment condenser 130 for condensing the refrigerant compressed in the refrigerating compartment compressor 110, a refrigerating compartment expansion unit 150 for expanding the refrigerant condensed in the refrigerating compartment condenser 130, and a refrigerating compartment evaporator 160 for evaporating the refrigerant expanded in the refrigerating compartment expansion unit 150 to cause the refrigerant to exchange heat with the refrigerating compartment R.

The refrigerating compartment compressor 110 compresses the low temperature and low pressure refrigerant introduced from the refrigerating compartment evaporator 160 into high temperature and high pressure refrigerant. The refrigerating compartment compressor 110 may adopt various types of compressors. For example, an inverter-driven compressor and a constant speed compressor may be adopted.

The refrigerating compartment condenser 130 is configured to condense the refrigerant compressed in the refrigerating compartment compressor 110. In other words, the refrigerating condenser 130 enables the refrigerant passing therethrough to exchange heat with outdoor air. The refrigerant having exchanged heat with the outdoor air is condensed in the refrigerating compartment condenser 130.

The refrigerating compartment expansion unit 150 expands the refrigerant condensed in the refrigerating compartment condenser 130. The refrigerating compartment expansion unit 150 is an apparatus configured to throttle the refrigerant introduced from the refrigerating compartment condenser 130.

For example, the refrigerating compartment expansion unit 150 may include an expansion valve or an electronic expansion valve.

The refrigerating compartment evaporator 160 evaporates the refrigerant expanded in the refrigerating compartment expansion unit 150 to cause the refrigerant to exchange heat with the refrigerating compartment R. The refrigerant, which passed through the refrigerating compartment evaporator 160, suffers change of phase, thus cooling the refrigerating compartment R. The refrigerant, having exchanged heat with the refrigerating compartment R, is again introduced into the refrigerating compartment compressor 110.

At this time, in order to achieve more efficient heat exchange, a refrigerating compartment fan 161 for causing air to flow around the refrigerating compartment evaporator 160 may further be provided. The refrigerating compartment fan 161 causes air in the refrigerating compartment R to flow around the refrigerating compartment evaporator 160 so as to maximize heat exchange between the air in the refrigerating compartment R and the refrigerant passing through the refrigerating compartment evaporator 160.

The refrigerating compartment compressor 110, the refrigerating compartment condenser 130, the refrigerating compartment expansion unit 150, and the refrigerating compartment evaporator 160 may be connected to one another through refrigerant pipes 171, 173, 174 and 175.

The freezing compartment cooling circuit 200 is configured to cool the freezing compartment F by circulating the refrigerant.

For example, the freezing compartment cooling circuit 200 includes the freezing compartment compressor 210 for compressing refrigerant, a freezing compartment condenser 230 for condensing the refrigerant compressed in the freezing compartment compressor 210, a freezing compartment expansion unit 250 for expanding the refrigerant condensed in the freezing compartment condenser 230, and a freezing compartment evaporator 260 for evaporating the refrigerant expanded in the freezing compartment expansion unit 250 so as to cause the refrigerant to exchange heat with the freezing compartment F.

The freezing compartment compressor 210 compresses low temperature and low pressure refrigerant introduced from the freezing compartment evaporator 260 into high temperature and high pressure refrigerant. The freezing compartment compressor 210 may adopt various types of structures, and an inverter-driven compressor and a constant speed compressor may be adopted.

The freezing compartment condenser 230 condenses the refrigerant compressed in the freezing compartment compressor 210. In other words, the freezing compartment condenser 230 causes the refrigerant passing therethrough to exchange heat with outdoor air. The refrigerant having exchanged heat with the outdoor air is condensed in the freezing compartment condenser 230.

The freezing compartment expansion unit 250 expands the refrigerant condensed in the freezing compartment condenser 230. The freezing compartment expansion unit 250 throttles the refrigerant introduced from the freezing compartment condenser 230.

For example, the freezing compartment expansion unit 250 may include an expansion valve or an electronic expansion valve.

The freezing compartment evaporator 260 evaporates the refrigerant expanded in the freezing compartment expansion unit 250 so as to exchange heat with the freezing compartment F. The refrigerant passing through the freezing compartment evaporator 260 undergoes change of phase, and thus cools the freezing compartment F. The refrigerant having exchanged heat in the freezing compartment evaporator 260 is again introduced into the freezing compartment compressor 210.

At this time, in order to achieve more efficient heat exchange, a freezing compartment fan 261 for causing air to flow around the freezing compartment evaporator 260 may further be provided. The freezing compartment fan 261 causes air in the freezing compartment F to flow around the freezing compartment evaporator 260.

The freezing compartment compressor 210, the freezing compartment condenser 230, the freezing compartment expansion unit 250, and the freezing compartment evaporator 260 may be connected to one another through refrigerant pipes 271, 273, 274 and 275.

In this specification, the refrigerating compartment fan 161 and the freezing compartment fan 261 may be collectively referred to as a fan, and the refrigerating compartment R and the freezing compartment F may be collectively referred to as a compartment or a storage compartment.

More specifically, the refrigerator according to the embodiment utilizes a 2COMP-2EVA system which includes the two compressors 110 and 210, the two evaporators 160 and 260, and the two fans 161 and 261 so as to separately cool the freezing compartment F and the refrigerating compartment R.

FIG. 3 is a control block diagram illustrating the refrigerator according to the embodiment of the present invention.

As illustrated in FIG. 3, the refrigerator according to the embodiment includes a control panel 54 through which a user inputs an operation command of the refrigerator, the freezing compartment temperature sensor 280 for detecting a temperature of the freezing compartment F, the refrigerating compartment temperature sensor 180 for detecting a temperature of the refrigerating compartment R, and the control unit 300 for controlling the refrigerating compartment compressor 110, the freezing compartment compressor 210, the freezing compartment fan 261, the refrigerating compartment fan 161 and the like in accordance with user input through the control panel 54 and loads of the freezing compartment F and the refrigerating compartment R.

The control unit 300 receives signals output from the freezing compartment temperature sensor 280 and the refrigerating compartment temperature sensor 180, and receives information regarding whether or not the refrigerating compartment compressor 110 and the freezing compartment compressor 210 are operated.

When both the freezing compartment F and the refrigerating compartment R have to be concurrently cooled, that is, when the freezing compartment F and the refrigerating compartment R are under the condition of concurrent cooling operation, the control unit 300 controls the refrigerating compartment compressor 110 and the freezing compartment compressor 210 in a concurrent cooling operation mode. Meanwhile, when the freezing compartment F and the refrigerating compartment R are under the condition of selective cooling operation, the control unit 300 controls the refrigerating compartment compressor 110 and the freezing compartment compressor 210 in such a manner as to operate one or both of the refrigerating compartment compressor 110 and the freezing compartment compressor 210 so as to proceed to a selective operation mode in consideration of the previous operation state. When it is unnecessary to concurrently cool the freezing compartment F and the refrigerating compartment R, that is, when a cooling operation is released, the control unit 300 controls the refrigerating compartment compressor 110 and the freezing compartment compressor 210 to be operated so as to proceed to a single operation mode in which one of the refrigerating compartment compressor 110 and the freezing compartment compressor 210 is operated. p When the freezing compartment F and the refrigerating compartment R have to perform concurrent cooling operation, the control unit 300 controls the refrigerating compartment compressor 110 and the freezing compartment compressor 210 to be concurrently operated so as to proceed to the concurrent operation mode. The term "concurrent operation mode" means that both the refrigerating compartment compressor 110 and the freezing compartment compressor 210 are operated to cool both the refrigerating compartment R and the freezing compartment F, respectively.

The concurrent cooling condition refers to a case in which it is necessary to concurrently cool the freezing compartment F and the refrigerating compartment R such as when a power code of the refrigerator is connected to a receptacle outlet installed at a building and the like, when a concurrent cooling command is input through the control panel 54 by a user, or when both the freezing compartment F and the refrigerating compartment R are at a high temperature.

In one instance, the concurrent cooling condition may refer to a case in which a temperature of the freezing compartment F detected by the freezing compartment temperature sensor 280 is equal to or higher than the concurrent cooling temperature of the freezing compartment F and a temperature of the refrigerating compartment R detected by the refrigerating compartment temperature sensor 180 is equal to or higher than the concurrent cooling temperature of the refrigerating compartment R.

The concurrent cooling temperature of the freezing compartment and the concurrent cooling temperature of the refrigerating compartment are predetermined temperatures for determining whether or not the freezing compartment F and the refrigerating compartment R have to be concurrently cooled. The concurrent cooling temperature of the freezing compartment F is preferably higher than a desired (or predetermined) temperature of the freezing compartment F, and the concurrent cooling temperature of the refrigerating compartment R is preferably higher than a desired (or predetermined) temperature of the refrigerating compartment R. For example, when the desired (or predetermined) temperature of the freezing compartment F is −19° C., the concurrent cooling temperature of the freezing compartment F may be set to −15.5° C. When the desired (or predetermined) temperature of the refrigerating compartment R is 2° C., the concurrent cooling temperature of the refrigerating compartment R may be set to 5.5° C.

Since the concurrent operation mode has to be executed such that the freezing compartment F and the refrigerating compartment R are rapidly cooled while reducing noise, the control unit 300 controls the refrigerating compartment fan 161 and the freezing compartment fan 261 to be operated in a low speed operation mode in the concurrent operation mode. The low speed operation mode means that a rotational speed of the fans is lower than that in a high speed operation mode which will be described later.

The single operation mode is a mode in which one of the refrigerating compartment compressor 110 and the freezing compartment compressor 210 is operated. When both the refrigerating compartment R and the freezing compartment F satisfy the cooling release condition in the single operation mode, both the freezing compartment compressor 210 and the refrigerating compartment compressor 110 may be stopped.

In the single operation mode, when one of the refrigerating compartment R and the freezing compartment F satisfies the cooling release condition, the compressor of the compartment that satisfies the cooling release condition is stopped whereas the compressor of the other compartment that does not satisfy the cooling release condition is continuously operated.

More specifically, when the freezing compartment F satisfies the cooling release condition, the control unit 300 halts operation of the freezing compartment compressor 210. When the refrigerating compartment R satisfies the cooling release condition, the control unit 300 halts operation of the refrigerating compartment compressor 110.

The cooling release condition is a case in which a temperature detected by the freezing compartment temperature sensor 280 is lower than the cooling release temperature of the freezing compartment or a temperature detected by the refrigerating compartment temperature sensor 180 is lower than the cooling release temperature of the refrigerating compartment.

The cooling release temperature of the freezing compartment and the cooling release temperature of the refrigerating compartment are predetermined temperatures, which determine halt of cooling of the freezing compartment F and the refrigerating compartment R. The cooling release temperature of the freezing compartment is preferably set to be lower than a desired (or preset) temperature of the freezing compartment, and the cooling release temperature of the refrigerating compartment is preferably set to be lower than a desired (or preset) temperature of the refrigerating compartment. For example, when the desired (or preset) temperature of the freezing compartment is −19° C., the cooling release temperature of the freezing compartment F may be set to −20° C. When the desired (or preset) temperature of the refrigerating compartment is 2° C., the cooling release temperature of the refrigerating compartment R may be set to 1° C.

The concurrent cooling temperature serves as the reference, which determines whether it is necessary to perform rapid cooling because a temperature of each compartment is excessively higher than the preset temperature. The cooling release temperature serves as a reference, which determines whether it is unnecessary to perform rapid cooling because a temperature of each compartment becomes lower than the preset temperature is determined.

The concurrent cooling temperature is set to be higher than the cooling release temperature.

Since only one compressor is operated in the single operation mode, operating noise is reduced, compared to a case in which two compressors are operated. Therefore, in the single operation mode, the control unit 300 controls the fan of the compartment, in which the associated fan is operated, to be operated in the high speed operation mode.

As a result, cooling efficiency of the compartment that is operated in the single operation mode is improved. More specifically, when a temperature of the freezing compartment F becomes lower than the cooling release temperature of the freezing compartment F, the control unit 300 controls the compressors and the fans in such a way as that operation of the freezing compartment compressor 210 is halted while operation of the freezing compartment compressor 210 is performed, and the freezing compartment fan 261 is operated in the high speed operation mode, or vice versa.

When the freezing compartment F and the refrigerating compartment R are under the selective cooling condition, the control unit 300 controls the refrigerating compartment compressor 110 and the freezing compartment compressor 210 in the selective operation mode in such a way as to concurrently operate the refrigerating compartment compressor 110 and the freezing compartment compressor 210 or to operate only one of the refrigerating compartment compressor 110 and the freezing compartment compressor 210.

The selective cooling condition is a case in which a temperature detected by the freezing compartment temperature sensor 280 is equal to or higher than the cooling release temperature of the freezing compartment F, a temperature detected by the refrigerating compartment temperature sensor 180 is equal to or higher than the cooling release temperature of the refrigerating compartment R, and one of the temperature detected by the freezing compartment temperature sensor 280 and the temperature detected by the refrigerating temperature sensor 180 is lower than the concurrent cooling temperature.

Since the cooling release temperature is lower than the concurrent cooling temperature, the selective cooling condition is, for example, a case in which a temperature of the freezing compartment F is equal to or higher than the cooling release temperature of the freezing compartment F, and a temperature of the refrigerating compartment R is equal to or higher than the cooling release temperature of the refrigerating compartment R and lower than the concurrent cooling temperature of the refrigerating compartment R. Furthermore, the selective cooling condition is a case in which a temperature of the freezing compartment F is equal to or higher than the cooling release temperature of the freezing compartment F and lower than the concurrent cooling temperature of the freezing compartment F, and a temperature of the refrigerating compartment R is equal to or higher than the cooling release temperature of the refrigerating compartment R.

Although the selective operation mode requires concurrent operation because temperatures of the refrigerating compartment R and the freezing compartment F are higher than the preset temperature, one or both of the two compressors are selectively operated in order to efficiently cool the freezing compartment F and the refrigerating compartment R while reducing noise generated by the concurrent operation of the two compressors.

In one instance, under the condition that one of the refrigerating compartment R and the freezing compartment F is assigned to a higher temperature region and the other compartment is assigned a lower temperature region, when the compressor of the compartment assigned the higher temperature region is already(or presently) operated, the selective operation mode may be executed in such a way that the compressor of the compartment assigned the higher temperature region is operated whereas the compressor of the compartment assigned the lower temperature region is stopped.

The lower temperature region and the higher temperature region are regions predetermined at a temperature range that is equal to or higher than the cooling release temperature.

The lower temperature region may be subdivided into a lower temperature region for the refrigerating compartment R and a lower temperature region for the freezing compartment F, and the higher temperature region may be subdivided into a higher temperature region for the refrigerating compartment R and a higher temperature region for the freezing compartment F.

The lower temperature region for the freezing compartment F is in a temperature range that is equal to or higher than the cooling release temperature of the freezing compartment F and lower than the concurrent cooling temperature of the freezing compartment F, and the higher temperature region for the freezing compartment F is a temperature range that is equal to or higher than the concurrent cooling temperature of the freezing compartment F.

For example, when the concurrent cooling temperature of the freezing compartment F is set to −15.5° C. and the cooling release temperature of the freezing compartment F is set to −20° C., the lower temperature region for the freezing compartment F may be a temperature range that is equal to or higher than −20° C. and lower than −15.5° C., and the higher temperature region for the freezing compartment F may be a temperature range that is equal to or higher than −15.5° C.

The lower temperature region for the refrigerating compartment R is a temperature range that is equal to or higher than the cooling release temperature of the refrigerating compartment R and lower than the concurrent cooling temperature of the refrigerating compartment R, and the higher temperature region for the refrigerating compartment R is a temperature range that is equal to or higher than the concurrent cooling temperature of the refrigerating compartment R.

For example, when the concurrent cooling temperature of the refrigerating compartment R is set to 5.5° C. and the cooling release temperature of the refrigerating compartment R is set to 1° C., the lower temperature region for the refrigerating compartment R may be a temperature range that is equal to or higher than 1° C. and lower than 5.5 ° C., and the higher temperature region for the refrigerating compartment R may be a temperature range that is equal to or higher than 5° C.

In other words, the higher temperature region requires cooling, that is, relatively rapid cooling, and the lower temperature region also requires slower cooling than in the higher temperature region.

Under the condition that one of the two compartments is in the higher temperature region and the other of the two compartments is in the lower temperature region, when the already(or presently) operated compressor is associated with the compartment in the higher temperature region, cooling is necessary because the compressor was already(or presently) operated. In this case, the selective operation mode is executed in such a way as to cause the compressor of the compartment in the higher temperature region to be continuously operated and to cause the compressor of the compartment in the lower temperature region to be stopped. Since a large amount of noise is generated during concurrent operation of the two compressors, priority is given to the compressor that was first operated so as to maintain cooling efficiency while reducing noise.

In another instance, under the condition that one of the refrigerating compartment R and the freezing compartment F is in the higher temperature region and the other is in the lower temperature region, when the compressor of the compartment in the lower temperature region is already(or presently) operated, the selective operation mode may be performed in such as way as to jointly operate both the refrigerating compartment compressor 110 and the freezing compartment compressor 210.

More specifically, under the condition that the freezing compartment F is in the higher temperature region for the freezing compartment and the refrigerating compartment R is in the lower temperature region for the refrigerating compartment, when the freezing compartment compressor 210 is first operated, the control unit 300 controls the freezing compartment compressor 210 to be continuously operated and controls the refrigerating compartment compressor 110 to be stopped. Furthermore, under the condition that the freezing compartment F is in the higher temperature region for the freezing compartment and the refrigerating compartment R is in the lower temperature region for the refrigerating compartment, when the refrigerating compartment compressor 110 is first operated, the control unit 300 controls the freezing compartment compressor 210 and the refrigerating compartment compressor 110 to be concurrently operated. Of course, the case in which the freezing compartment F and the refrigerating compartment R are in the opposite regions is also controlled in the manner as described above.

In a further instance, when the refrigerating compartment R and the freezing compartment F are in the lower temperature region, the selective operation mode may be performed in such a way that the already(or presently) operated compressor is continuously operated whereas the other compressor that was already(or presently) stopped remains stopped. In other words, when both the compartments are in the lower temperature region and thus it is unnecessary to perform rapid cooling, priority is given to the already(or presently) operated compressor, so as to first cool the compartment which includes the compressor being operated.

More specifically, under the condition that the freezing compartment F and the refrigerating compartment R are in the lower temperature region, when the freezing compartment compressor 210 is first operated, the control unit 300 controls only the freezing compartment compressor 210 to be continuously operated. In this case, when the refrigerating compartment compressor 110 is first operated, the control unit 300 controls only the refrigerating compartment compressor 110 to be continuously operated.

When both the refrigerating compartment compressor 110 and the freezing compartment compressor 210 are operated in the selective operation mode, the control unit 300 may control the fan of the compartment in the lower temperature region to be operated in the low speed operation mode and controls the fan of the compartment in the higher temperature region to be operated in the high speed operation mode.

More specifically, under the condition that the freezing compartment F is in the higher temperature region for the freezing compartment and the refrigerating compartment R is in the lower temperature region for the refrigerating compartment, when the refrigerating compartment compressor 110 is first operated, the control unit 300 controls the freezing compartment compressor 210 and the refrigerating compartment compressor 110 to be concurrently operated. At this time, the control unit 300 controls the refrigerating compartment fan 161 in the lower temperature region to be operated in the low speed operation mode and controls the freezing compartment fan 261 to be operated in the high speed operation mode.

In this embodiment, under the selective cooling condition, the fan of the compartment in the higher temperature region which requires a large cooling amount is controlled to be operated in the high speed operation mode. Under the concurrent cooling condition, the fan of the compartment in the lower temperature region which requires a small cooling amount is controlled to be operated in the low speed operation mode. In the concurrent operation mode, speeds of the fans are controlled in accordance with temperatures of respective compartments. As a result, noise generated from the refrigerator may be reduced and cooling capacities of the respective compartments may be maintained.

In this specification, the low speed operation mode and the high speed operation mode mean predetermined ranges of rotational speed of the fans. Specifically, a rotational speed of the fan in the high speed operation mode may be determined to be higher than that of the fan in the low speed operation mode.

FIG. 4 illustrates operation states of the refrigerating compartment compressor 110 and/or the freezing compartment compressor 210 in various operation modes and in various temperatures of the refrigerating compartment and the freezing compartment.

In the drawing, the term "satisfaction" means that, in the case of the freezing compartment F, a temperature detected by the freezing compartment temperature sensor 280 is lower than the cooling release temperature of the freezing compartment and that, in the case of the refrigerating compartment R, a temperature detected by the refrigerating compartment temperature sensor 180 is lower than the cooling release temperature of the refrigerating compartment.

Furthermore, the term "low temperature" refers to the above-mentioned lower temperature region, and the term "high temperature" refers to the above-mentioned higher temperature region. The lower temperature region and the higher temperature region are the same as described above. Accordingly, the concurrent cooling condition is a case in which both the refrigerating compartment R and the freezing compartment F are in the higher temperature region. FIG. 4 illustrates operation states of the refrigerating compartment compressor 110 and the freezing compartment compressor 210 in various operation modes.

FIG. 5 is a flowchart illustrating a method of controlling a refrigerator according to an embodiment of the present invention. Referring to FIG. 5, the method of controlling a refrigerator according to the embodiment may include a concurrent cooling operation of controlling the refrigerating compartment compressor 110 and the freezing compartment compressor 210 to be concurrently operated so as to proceed to a concurrent operation mode (S11-S17), a selective cooling operation of controlling one or both of the refrigerating compartment compressor 110 and the freezing compartment compressor 210 to be operated so as to proceed to a selective operation mode in consideration of the previous operation state (S14 and S15), and a single cooling operation of controlling one of the refrigerating compartment compressor 110 and the freezing compartment compressor 210 to be operated so as to proceed to a single operation mode (S18-S21).

As described above, the concurrent cooling operation S11-S17 is performed in such a way as to concurrently operate the refrigerating compartment compressor 110 and the freezing compartment compressor 210 when the refrigerating compartment R and the freezing compartment F have to be concurrently cooled.

Specifically, when a temperature of the refrigerating compartment R detected by the refrigerating compartment temperature sensor 180 is equal to or higher than the concurrent cooling temperature of the refrigerating compartment R (S11) and a temperature of the freezing compartment F detected by the freezing compartment temperature sensor 280 is equal to or higher than the concurrent cooling temperature of the freezing compartment F (S12), the control unit 300 controls the refrigerating compartment compressor 110 and the freezing compartment compressor 210 to be concurrently operated so as to proceed to the concurrent operation mode (S13).

The selective cooling operation (S14 and S15) is performed in the selective operation mode.

The selective cooling operation (S14 and S15) is performed when a temperature detected by the freezing compartment temperature sensor 280 is equal to or higher than the cooling release temperature of the freezing compartment, a temperature detected by the refrigerating compartment temperature sensor 180 is equal to or higher than the cooling release temperature of the refrigerating compartment, and one of the temperature detected by the freezing compartment temperature sensor 280 and the temperature detected by the refrigerating compartment temperature sensor 180 is lower than the concurrent cooling temperature.

Specifically, the selective cooling operation (S14 and S15) may include a procedure of determining a compressor that is already(or presently) operated, a procedure of determining whether the refrigerating compartment R and the freezing compartment F are in the lower temperature region or the higher temperature region, and a procedure of determining whether the compartment in which the already(or presently) operated compressor is disposed is in the lower temperature region or the higher temperature region so as to operate one or both of the refrigerating compartment compressor 110 and the freezing compartment compressor 210.

More specifically, the control unit 300 controls in such a way as to determine a compressor that is already(or presently) operated and then to operate one or both of the refrigerating compartment compressor 110 and the freezing compartment compressor 210 depending on whether the compartment in which the already(or presently) operated compressor is disposed is in the lower temperature region or the higher temperature region. At this time, the respective determination procedures are the same as described in the selective operation mode.

In the selective cooling operation (S14 and S15), when both of the refrigerating compartment compressor 110 and the freezing compartment compressor 210 are operated, the control unit 300 may control the fan of the compartment in the lower temperature region to be operated in the low speed operation mode and the fan of the compartment in the higher temperature region to be operated in the high speed operation mode.

As described above, the single cooling operation (S18-S21) is performed in such a way as to operate one of the refrigerating compartment compressor 110 and the freezing compartment compressor 210 when there is no need to concurrently cool the freezing compartment F and the refrigerating compartment R.

Specifically, the control unit 300 controls the compressor of the compartment that first reaches the cooling release condition among the refrigerating compartment R and the freezing compartment F to be stopped and controls only the compressor of the compartment that has not reached the cooling release condition to be operated (S18-S21). Here, the priority of operation is given to the refrigerating compartment R.

More specifically, when a temperature detected by the freezing is lower than the concurrent cooling temperature of the freezing compartment F (S18), the control unit 300 controls the freezing compartment compressor 210 to be stopped (S19). Meanwhile, when a temperature detected by the refrigerating temperature sensor 180 is lower than the concurrent cooling temperature of the refrigerating compartment R (S20), the control unit 300 controls the refrigerating compartment compressor 110 to be stopped (S21). The control unit 300 determines the respective conditions based on the preset temperatures as described above.

As is apparent from the above description, the refrigerator and the method of controlling the same, according to the present invention have one or more of the following effects.

In one embodiment, by virtue of use of the two compressors and the two evaporators, the freezing compartment and the refrigerating compartment may be rapidly cooled in accordance with temperatures thereof.

In one embodiment, when both of the refrigerating compartment and the refrigerating compartment are in the higher temperature region, the two compressors are concurrently operated, thus rapidly cooling the compartments.

In one embodiment, since a rotational speed of the fan of the compartment that is less necessary to cool is reduced when the freezing compartment and the refrigerating compartment are concurrently cooled, both the refrigerating compartment and the freezing compartment may be more efficiently cooled in addition to reduction of noise.

In one embodiment, when it is necessary to cool only one of the refrigerating compartment and the freezing compartment, energy may be conserved by cooling only the compartment requiring cooling.

In one embodiment, since a large amount of noise is generated when the two compressors are concurrently operated, only the compressor that was first operated is operated, thus maintaining cooling efficiency while reducing noise. p It will be appreciated by those skilled in the art that the effects that can be achieved through the present invention are not limited to what has been particularly described hereinabove and other advantages of the present invention will be more clearly understood from the accompanying claims.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A refrigerator comprising:

a refrigerator body with a refrigerating compartment and a freezing compartment;

a refrigerating compartment cooling circuit with a refrigerating compartment compressor that is configured to compress refrigerant, a refrigerating compartment condenser that is configured to condense the refrigerant compressed in the refrigerating compartment compressor, a refrigerating compartment expansion unit that is configured to expand the refrigerant condensed in the refrigerating compartment condenser, a refrigerating compartment evaporator that is configured to evaporate the refrigerant expanded in the refrigerating compartment expansion unit, and that causes the refrigerant to exchange heat with the refrigerating compartment;

a freezing compartment cooling circuit with a freezing compartment compressor that is configured to compress refrigerant, a freezing compartment condenser that is configured to condense the refrigerant compressed in the freezing compartment compressor, a freezing compartment expansion unit that is configured to expand the refrigerant condensed in the freezing compartment condenser, a freezing compartment evaporator that is configured to evaporate the refrigerant expanded in the freezing compartment expansion unit, and that causes the refrigerant to exchange heat with the freezing compartment;

a refrigerating compartment temperature sensor that is configured to measure a temperature of the refrigerating compartment;

a freezing compartment temperature sensor that is configured to measure a temperature of the freezing compartment; and a control unit that is configured to control the refrigerating compartment compressor and the freezing compartment compressor to operate concurrently to cool the refrigerating compartment and the freezing compartment when the freezing compartment and the refrigerating compartment satisfy a concurrent cooling condition and are in a first operation mode, and that is configured to control at least one of the refrigerating compartment compressor and the freezing compartment compressor based on a previous operating mode when the refrigerating compartment and the freezing compartment satisfy a selective cooling condition and are in a second operation mode, wherein, when at least one of the refrigerating compartment or the freezing compartment satisfies a cooling release condition and a third operation mode is selected, the control unit is configured to control one of the refrigerating compartment compressor or the freezing compartment compressor to stop, wherein the concurrent cooling condition is satisfied when a temperature detected by the freezing compartment temperature sensor is equal to or higher than a concurrent cooling temperature of the freezing compartment, and a temperature detected by the refrigerating compartment temperature sensor is equal to or higher than a concurrent cooling temperature of the refrigerating compartment, wherein the cooling release condition is satisfied when a temperature detected by the freezing compartment temperature sensor is lower than a cooling release temperature of the freezing compartment or a temperature detected by the refrigerating chamber temperature sensor is lower than a cooling release temperature of the refrigerating chamber, and wherein the selective cooling condition is satisfied when a temperature detected by the freezing compartment temperature sensor is equal to or higher than a cooling release temperature of the freezing compartment, a temperature detected by the refrigerating compartment temperature sensor is equal to or higher than a cooling release temperature of the refrigerating compartment, and one of the temperature detected by the freezing compartment temperature sensor and the temperature detected by the refrigerating compartment temperature sensor is lower than a concurrent cooling temperature.

2. The refrigerator according to claim 1, wherein the second operation mode is executed in such a way that, under a condition that one of the refrigerating compartment and the freezing compartment is in a higher temperature region and the other of the two compartments is in a lower temperature region, when the compressor of the compartment in the higher temperature region is already operated, the compressor of the compartment in the higher temperature region is operated and the compressor of the compartment in the lower temperature region is stopped.

3. The refrigerator according to claim 1, wherein the second operation mode is executed in such a way that, under the condition that one of the refrigerating compartment and the freezing compartment is in a higher temperature region and the other of the two compartments is in a lower temperature region, when the compressor of the compartment in the lower temperature region is already operated, both the refrigerating compartment compressor and the freezing compartment compressor are operated.

4. The refrigerator according to claim 1, wherein the second operation mode is executed in such a way that, when the refrigerating compartment and the freezing compartment are in a lower temperature region, a compressor that is already operated is continuously operated and a compressor that was stopped remains stopped.

5. The refrigerator according to claim 3, further comprising:

a refrigerating compartment fan that is configured to cause air near the refrigerating compartment evaporator to flow; and a freezing compartment fan that is configured to cause air near the freezing compartment evaporator to flow, wherein, when both the refrigerating compartment compressor and the freezing compartment compressor are operated in the second operation mode, the control unit is configured to control the fan of the compartment in the lower temperature region to operate in a low speed operation mode, and to control the fan of the compartment in the higher temperature region to operate in a high speed operation mode.

6. The refrigerator according to claim 1, further comprising:

a refrigerating compartment fan that is configured to cause air near the refrigerating compartment evaporator to flow; and a freezing compartment fan that is configured to cause air near the freezing compartment evaporator to flow, wherein the control unit is configured to control the refrigerating compartment fan and the freezing compartment fan to operate in a low speed operation mode in the first operation mode.

7. The refrigerator according to claim 1, wherein the control unit is configured to control the fan of the compartment that includes the compressor that is currently being operated, to be operated in a high speed operation mode in the single operation mode.

8. A method of controlling a refrigerator, wherein the refrigerator comprises:

a refrigerating compartment cooling circuit with a refrigerating compartment compressor that is configured to compress refrigerant, a refrigerating compartment condenser that is configured to condense the refrigerant compressed in the refrigerating compartment compressor, a refrigerating compartment expansion unit that is configured to expand the refrigerant condensed in the refrigerating compartment condenser, a refrigerating compartment evaporator that is configured to evaporate the refrigerant expanded in the refrigerating compartment expansion unit, and that causes the refrigerant to exchange heat with a refrigerating compartment, a freezing compartment cooling circuit with a freezing compartment compressor that is configured to compress refrigerant, a freezing compartment condenser that is configured to condense the refrigerant compressed in the freezing compartment compressor, a freezing compartment expansion unit that is configured to expand the refrigerant condensed in the freezing compartment condenser, and a freezing compartment evaporator that is configured to evaporate the refrigerant expanded in the freezing compartment expansion unit, and that causes the refrigerant to exchange heat with a freezing compartment, the method comprising:

performing a first operation mode of controlling the refrigerating compartment compressor and the freezing compartment compressor to operate concurrently;

performing a second operation mode of controlling at least one of the refrigerating compartment compressor and the freezing compartment compressor based on a previous operating mode; and performing a third operation mode of controlling one of the refrigerating compartment compressor and the freezing compartment compressor to operate and the other of the refrigerating compartment compressor and the freezing compartment compressor to stop, wherein the first operation mode is performed when a temperature detected by a freezing compartment temperature sensor is equal to or higher than a concurrent cooling temperature of the freezing compartment and a temperature detected by a refrigerating compartment temperature sensor is equal to or higher than a concurrent cooling temperature of the refrigerating compartment, wherein the third operating mode causes the operation of compressor of one of the refrigerating compartment and the freezing compartment that satisfies a cooling release condition, and wherein the second operation mode is performed when a temperature detected by a freezing compartment temperature sensor is equal to or higher than a cooling release temperature of the freezing compartment, a temperature detected by a refrigerating compartment temperature sensor is equal to or higher than a cooling release temperature of the refrigerating compartment, and a temperature of one of the freezing compartment and the refrigerating compartment is lower than a concurrent cooling temperature.

9. The method according to claim 8, wherein the second cooling operation comprises:

determining a compressor that is already operated;

determining whether the refrigerating compartment and the freezing compartment is in a lower temperature region or a higher temperature region; and determining whether the compartment in which the already operated compressor is disposed is in the lower temperature region or the higher temperature region to operate at least one of the refrigerating compartment compressor and the freezing compartment compressor.

10. The method according to claim 9, wherein the second cooling operation further comprises:

controlling the fan of the compartment in the lower temperature region to be operated in the low speed operation mode and the fan of the compartment in the higher temperature region to be operated in the high speed operation mode, when both of the refrigerating compartment compressor and the freezing compartment compressor are operated.

* * * * *